United States Patent [19]

Franz et al.

[11] Patent Number: 4,611,391

[45] Date of Patent: Sep. 16, 1986

[54] COMMUTATOR RING MANUFACTURING METHOD AND APPARATUS

[75] Inventors: Peter Franz, Diekholzen; Werner Ross, Hildesheim, both of Fed. Rep. of Germany

[73] Assignee: Robert Bosch GmbH, Stuttgart, Fed. Rep. of Germany

[21] Appl. No.: 552,984

[22] Filed: Nov. 17, 1983

[30] Foreign Application Priority Data

Nov. 19, 1982 [DE] Fed. Rep. of Germany ..... 3242702

[51] Int. Cl.[4] ..... H01R 43/06

[52] U.S. Cl. ..... 29/597; 72/354; 72/370

[58] Field of Search ..... 29/597; 72/354, 370; 310/236

[56] References Cited

U.S. PATENT DOCUMENTS

| | | | |
|---|---|---|---|
| 3,423,819 | 1/1969 | Carlson et al. | 29/597 X |
| 3,608,350 | 9/1971 | Yamaguchi | 29/597 X |
| 3,664,012 | 5/1972 | Wilke et al. | 29/597 |
| 3,708,872 | 1/1973 | Ohuchi et al. | 29/597 |
| 3,768,295 | 10/1973 | Cudzik | 72/465 X |
| 3,958,326 | 5/1976 | Matsumoto et al. | 29/597 |
| 4,299,112 | 11/1981 | Kondo et al. | 72/352 X |
| 4,463,590 | 8/1984 | Theobald | 72/354 |

*Primary Examiner*—Howard N. Goldberg
*Assistant Examiner*—Joseph M. Gorski
*Attorney, Agent, or Firm*—Frishauf, Holtz, Goodman & Woodward

[57] ABSTRACT

A method for manufacturing commutator segmental rings, in which ring-shaped blanks (1) are transformed into commutator segmental rings. The method is carried out with a forming apparatus which uses a ring-shaped die (21) and a rib-forming die (25) to transform the blank (1) into a commutator segmental ring (2) with a flange (4) on its end and a shaft portion (3) with commutator segments (5) and cross pieces (7) connecting them. During the forming process, the die (25) moves against the force of an adjustable elastic counter-pressure apparatus (16; 13, 17, 19; 28). The counter-pressure on the facing side (24) of the upper punch (22), on which the die (25) fits, minimizes formation of a burr on the workpiece, and it permits use of a fastening means of reduced clamping power, thereby according the die (25) a greater pressure stability.

4 Claims, 4 Drawing Figures

COMMUTATOR RING MANUFACTURING METHOD AND APPARATUS

The present invention relates to a method of manufacturing commutator rings, and more particularly to the manufacture of a commutator ring with a circumferential flange and multiple inwardly projecting ribs from a blank metal ring by cold-drawing.

Background

It is known to use cold-drawing in the manufacture of a commutator ring with a flange on one end. Using the known cold-drawing method, a burr similar to an inner shoulder may be produced on the facing side of the flange and this burr extends radially into the interior of the commutator segmental ring. In known forming apparatus, the die on the facing side of the upper punch is fastened with a screw, which cannot hinder the formation of the burr on the commutator segmental ring, however large its shaft diameter. The greater the shaft diameter of the screw, the more the material or operating pressure stability of the die is impaired. Thereby the service life of the forming apparatus is shortened.

The Invention

It is an object to minimize the formation of a burr on the facing side of the flange of the commutator segment ring.

Briefly, a ring-shaped blank placed in the forming apparatus is transformed into a commutator segmental ring by a circular die which forms the outer face and a downward-acting die which forms the inner ribs of the segmental ring in a single power stroke of the punch. Simultaneously, a counter-pressure device presses with an adjustable and, if necessary, elastic counter-pressure against the rib-forming die of the downward-acting punch. The rib-forming die is fastened on the facing side of the upper punch by means which increase the pressure stability of the die. During the return stroke of the punch and the rib-forming die, the forming apparatus opens and the commutator segmental ring is pushed through the plate of the forming apparatus to a removal position.

These features have additional advantages. The fact that the elastic counter-pressure enhances the pressure density tolerance of the rib-forming die means that die can be fastened with a screw of smaller diameter, which increases the presssure stability and thereby the service life of the die. The counter-pressure apparatus in its return stroke to its initial position serves as an ejector for the segmental commutator ring.

DRAWING

DETAILED DESCRIPTION

Figure 1:
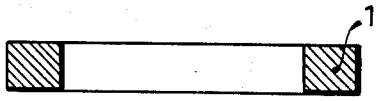
FIG. 1 is a longitudinal cross section of a blank for a commutator segment ring.
Figure 2:
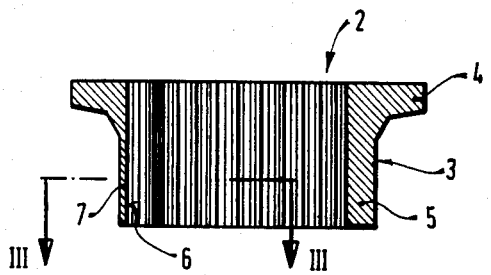
FIG. 2 is a longitudinal cross section of a commutator segment ring.
Figure 3:
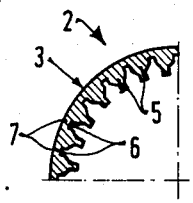
FIG. 3 is a partial cross section of a commutator segment ring along line III—III in FIG. 2.

A blank 1 for a commutator segment ring 2 of a commutator is made of a material adapted for commutators, for example copper. The blank 1 has the form of a ring with a generally rectangular or round cross section. The blank 1 can be a slice from a hollow cylinder.

Equally well, the blank 1 can be formed from a slice of rod which has been bent into a ring.

In accordance with the invention, for cold-drawing of the blank 1 into a commutator segmental ring 2, a ring-shaped blank 1 is converted into a shaft portion 3 with a flange 4. A die introduced into the shaft portion 3 of the blank 1 produces a plurality of axial inner ribs, which are arranged at equal intervals from each other. The inner ribs form commutator segments 5 which are separated from each other by segment grooves 6 and connected only by small cross pieces 7. If it is desired to further reduce consumption of raw materials required in producing the commutator segmental rings 2, the cross pieces 7 can be made arcuate on the outside. Alternatively, the blank 1 can be pressed together in a separate step to arch the cross pieces 7. To make the segments, cross pieces 7 are later removed, as will appear.

Figure 4:
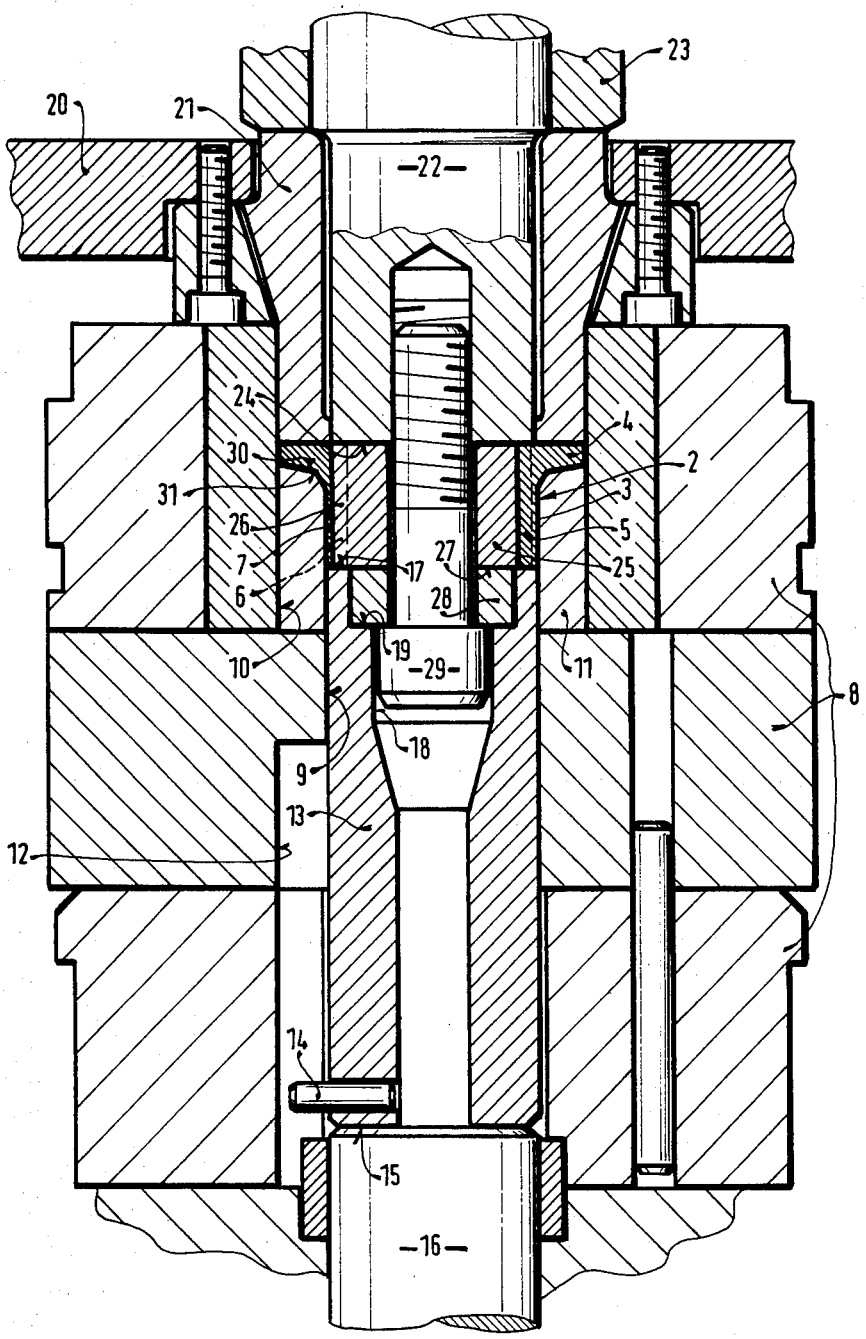
FIG. 4 is a longitudinal cross section of a forming apparatus at the end of its power stroke.

The cold-drawing of the blank 1 into a commutator segment ring is accomplished in a multi-part forming apparatus in one single power stroke. FIG. 4 illustrates a typical forming apparatus in the position at the end of the power stroke. In a lower punch plate 8, a longitudinal bore 9 is provided with a widened receiving section 10.

A hollow cylindrical female piece or matrix 11 of an extrusion mold is located in the receiving section 10. The inner shape of this female piece or matrix 11 corresponds to the outer shape of the commutator segment ring to be formed. A selector shaft guide slot 12 is formed in the longitudinal bore 9. A longitudinally movable lower or counter punch 13 is introduced into the longitudinal bore 9. A radially disposed peg 14 in the punch 13 extends into the selector shaft guide slot 12. This is a suitable example of how to guide the lower, or counter punch 13 in desired alignment and proper longitudinal motion. The longitudinal and rotational movement of the punch 13 can also be limited by other devices which are well known in the control and actuation art, and which need not be further illustrated here. The lower face 15 of the lower, or counter punch 13 abuts the upper end of control piston 16 which projects into the longitudinal bore 9. The lower end of the control piston 16 abuts, in a known manner not illustrated here, on an elastic counter-pressure control element, such as a hydraulic counter-pressure element or a gas spring.

The upper face 17 of the lower punch 13 is provided with a coaxial depression 18 to define a shelf 19. The depression 18 can also be formed as a longitudinal bore.

A ring die 21 is fastened in a middle punch plate 20. Punch plate 20 is movable with respect to the lower punch plate 8. The ring outer diameter on the ring die 21 corresponds to the diameter of the receiving section 10 in the lower punch plate 8. In the ring die 21 is disposed a longitudinally movable upper punch 22, which is received in an upper punch plate 23. The middle and upper punch plate 20 and 23 are movable together and with respect to each other. An upper die 25 is arranged on the facing side 24 of the upper punch 22. The upper die 25 is provided at its periphery with a number of teeth 26 which are formed at equal angular intervals from each other and whose profile corresponds to the segment grooves 6 of the commutator ring 2. The upper die 25 therefore will have the function of a forming, or shaping die. The face 27 of the upper die 25 remote from the upper punch 22 is abutted by a pressure ring 28 whose outer diameter is somewhat smaller than the diameter of the ring of teeth on the die 25. A screw 29 whose head abuts the pressure ring 28 fastens both the die 25 and the pressure ring 28 to the facing side 24 of the upper punch 22. The use of the pressure ring 28 permits an extremely tight fastening of the die 25 with a screw 29 of relatively small diameter. By the use of the thinner screw 29 a longer service life of the upper die 25 is achieved since the cross section of the upper die 25 can remain relatively large and it therefore will have a large counter-pressure absorption volume.

The female piece or matrix 11 of the extrusion mold, which is disposed in the receiving section 10 of the lower punch plate 8, has a slightly conical inner side 30. The transition between the side 30 and the central bore of the female piece 11 is formed as a chamfer 31.

Operation:

In the starting position of the apparatus for the loading of the blank 1, the middle and upper punch plates 20 and 23 along with the ring die 21, and the upper punch 22 with its upper die 25, are raised up and above the lower punch plate 8 and held in their highest position. The upper punch 22 is therefore drawn well back into the ring die 21. The lower punch 12 has been pushed so far into the extrusion mold female piece 11 by the control piston 16 that the face 17 of the punch 13 borders on the face 30 of the extrusion mold female piece 11.

The blank 1 is placed in the receiving section 10 of the lower punch plate 8, so that the blank rests on the face 30 of the extrusion mold female piece 11.

During the power stroke, the middle and upper punch plates 20 and 23 with the ring die 21, and the upper punch 22 with its die upper 25 are moved down onto the blank 1. Once the ring die 21, which has been introduced into the receiving section 10, rests on the blank 1, the upper punch 22 with its upper die 25 is moved further into the blank 1, until the face of the die 25 which abuts the facing edge 24 of the upper punch 22 is in the plane of the facing side of the ring die 21. The upper punch plate 23 now rests on the ring die 21 adjacent the middle punch plate 20. When the face 27 of the upper die 25, in its movement through the blank 1 into the extrusion mold 11 strikes the lower punch 23 or when the pressure ring 28 strikes the shelf 19 of the lower punch 13, the upper die 25 presses the lower punch 13 back into the longitudinal bore 9 of the lower punch plate 8 against the force exerted by the control piston 16 and the adjustable elastic control means which supports it.

The punch plates 20 and 23 with the ring die 21 and the upper punch 22 with the die 25 and the pressure ring 28 are then commonly moved further downwardly. The ring die 21 forms the flange 4. The material displaced thereby from the blank 1 is extruded into the shaft 3 to form the commutator segments 5 between the teeth 26 of the upper die 25 and the cross pieces 7 between the inner wall of the extrusion mold 11 and the outer face of the teeth 26. The force transmitted by this process through the pressure ring 28 onto the facing side 27 of the upper die 25 and, likewise, from die 25 onto the facing side 24 of the upper punch 22, guarantees during the forming process appropriate pressure per unit area at the facing sides 24 and 27 so that there can be formed no undesired burr on the commutator segmental rings 2, which would extend radially into the interior of the commutator segmental ring 2. The lower punch 13 acts as a counter-element to press with the same force against the die 25 and the pressure ring 28. As a result, the lower punch 13 increases the force transmitted through the pressure ring 28 onto the facing sides 24 and 27 so that the screw 29 may have a smaller diameter in comparison with screws of the prior art. The lower punch 13 simultaneously forms a limit to the length of the shaft portion 3 on the side of the commutator segmental ring 2 remote from the flange 4 by resiliently closing off the extrusion chamber. At the end of the power stroke for transformation of the blank 1 into the commutator segmental ring 2, the middle punch plate 20 rests on top of the lower punch plate 8.

For removal of the now formed commutator segmental ring 2 from the forming apparatus, the apparatus is opened in such a manner that the middle and upper punch plates 23 are retracted into the starting position along with the ring die 21, the upper punch 22 and the die 25, while the lower punch 13 ejects the commutator segment into removal position from the extrusion mold 11 and from the receiving section 10 of the lower punch plate 8, before the lower punch 13 returns to its starting position.

The commutator segmental ring 2 can then be used to easily make a finished commutator. In known manner, not shown, anchoring means and an insulating hub are provided, in which the commutator segments 5 are anchored. At the same time, the commutator segments 5 are separated by removal of the cross pieces 7. The connecting lugs formed in the flange 4 can be provided with wire receiving slots to complete the commutator.

With the method of this invention, the commutator segmental ring 2 can be formed equally well by forward extrusion or backward extrusion from the blank 1.

Various changes and modifications may be made within the scope of the inventive concept.

We claim:

1. A method of making a commutator ring having a tubular portion (3) that defines an outer tubular diameter, inner ribs (5) that define anchoring means, and a flange (4) that defines an outer flange diameter, said method comprising the steps of:

providing a ring-shaped blank (1) defining an outer ring diameter and an inner opening;

introducing said blank (1) into a receiving section (10) of a forming apparatus, said forming apparatus having:

a matrix (11) including an inner wall that is shaped to form an outer surface of the commutator ring (2);

a ring-shaped die (21);

a composite upper die (22,25) that is inserted into the ring-shaped die, said composite upper die including a die punch (22) that has a punching end surface (24), and a rib-forming upper die (25,28) having outer surfaces that are shaped to form said inner ribs (5), having a first die punch end face engagement surface, and having a second engagement end face (19,27) that is remote from the first die punch end face engagement surface;

a holding screw (29) passing through the rib-forming upper die (25,28) and into the die punch (22), and separably fastening the die punch (22) onto the upper die (25,28) while leaving at least a portion of the second engagement end face (19,27) exposed; and a lower punch element (13) that is inserted into the matrix (11);

applying the ring-shaped die (21) against a face of the blank (1);

introducing the lower punch element (13) into the matrix and at least up to the blank;

introducing the rib-forming upper die (25,28) into the inner opening of the ring-shaped blank (1), and directly positioning the lower punch element with counter pressure against said at least portion of the second engagement end face (19,27); then moving the rib-forming upper die (25,28) into the inner opening of the ring-shaped blank (1) and penetrating the rib-forming upper die into engagement with said blank, thereby forming the inner ribs, and thereby cold flowing the metal of the blank between the matrix and an outer surface of the rib-forming upper die (25,28), while continually applying counter pressure by the lower punch element (13) against said at least portion of the second engagement end face (19,27), thereby moving the lower punch element (13) while the lower punch element continually applies counter pressure against said at least portion, which thereby controls flow of the metal of the blank around the rib-forming upper die within the matrix and prevents formation of flashing between the die punch (22) and the rib-forming upper die (25) and thereby forming a segmental ring.

2. Method according to claim 1, further comprising the steps of:

retracting said ring-shaped die (21) and said rib-forming upper die (25,28) from said segmental ring subsequently said moving step; and moving the power punch element (13) upwardly through said matrix, thereby ejecting the segmental ring from within said matrix (11) to a removal position.

3. The method of claim 1, wherein the inner wall of the matrix (11), the ring-shaped die, and the rib-forming upper die (25,28) define an extrusion chamber;

and said step of positioning the lower punch element (13) with counter pressure against said at least portion of the second engagement end face (19,27) comprises positioning said punch element (13) with resilient pressure against said at least portion, thereby resiliently closing off said extrusion chamber.

4. The method of claim 1, wherein said step of applying counter pressure by said lower punch (13) comprises elastically and controllably applying pressure counter a force that is moving the rib-forming die (25,28) into the ring-shaped blank.

* * * * *